US008878458B2

(12) United States Patent
An

(10) Patent No.: US 8,878,458 B2
(45) Date of Patent: Nov. 4, 2014

(54) LIGHT SOURCE DRIVING CIRCUIT AND DISPLAY DEVICE INCLUDING THE SAME

(75) Inventor: Sung Bo An, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 453 days.

(21) Appl. No.: 13/200,333

(22) Filed: Sep. 23, 2011

(65) Prior Publication Data

US 2012/0181947 A1 Jul. 19, 2012

(30) Foreign Application Priority Data

Jan. 13, 2011 (KR) ..... 10-2011-0003579

(51) Int. Cl.
*H05B 37/02* (2006.01)
*G09G 3/34* (2006.01)

(52) U.S. Cl.
CPC ..... *G09G 3/342* (2013.01); *G09G 2320/064* (2013.01)
USPC ..... 315/299; 315/169.3; 345/102

(58) Field of Classification Search
CPC ..... H05B 37/02; G09G 3/34; G09G 3/36
USPC ..... 315/169.2, 169.3, 291, 294, 297, 299; 345/48, 50, 51, 55, 84, 87, 90, 92, 102, 345/690, 214
See application file for complete search history.

(56) References Cited

U.S. PATENT DOCUMENTS

| | | | | |
|---|---|---|---|---|
| 7,106,294 | B2 * | 9/2006 | Kumamoto et al. | 345/102 |
| 8,169,245 | B2 * | 5/2012 | Zhao | 327/175 |
| 2007/0211014 | A1 * | 9/2007 | Kim et al. | 345/102 |
| 2009/0267530 | A1 * | 10/2009 | Yang et al. | 315/250 |
| 2009/0302769 | A1 * | 12/2009 | Trattler et al. | 315/152 |
| 2010/0026201 | A1 | 2/2010 | Byun et al. | |
| 2011/0164069 | A1 * | 7/2011 | Thompson et al. | 345/690 |

FOREIGN PATENT DOCUMENTS

| | | | |
|---|---|---|---|
| CN | 101640030 | A | 2/2010 |
| EP | 2149871 | A2 | 2/2010 |
| JP | 2001-033056 | A | 2/2001 |
| KR | 10 2010-0012599 | A | 2/2010 |

* cited by examiner

*Primary Examiner* — Thuy Vinh Tran
(74) *Attorney, Agent, or Firm* — Lee & Morse, P.C.

(57) ABSTRACT

A display device includes a display panel having a plurality of pixels for displaying an image, a light source on the display panel, and a light source driving circuit configured to drive the light source. The light source driving circuit for driving a light source includes a driving voltage generator configured to supply power to a light source, and a light source controller configured to generate a light source control signal for periodically turning on/off the light source, the light source being turned on again before being turned off completely.

16 Claims, 5 Drawing Sheets

LIGHT SOURCE DRIVING CIRCUIT AND DISPLAY DEVICE INCLUDING THE SAME

CROSS-REFERENCE TO RELATED APPLICATIONS

This U.S. non-provisional patent application claims priority under 35 U.S.C. §119 of Korean Patent Application No. 10-2011-0003579, filed on Jan. 13, 2011, the entire contents of which are hereby incorporated by reference.

BACKGROUND

The present disclosure herein relates to a light source driving circuit and a display device including the same.

Due to features such as lightening, thinning, and low consumption power driving, the application scopes of Liquid Crystal Displays (LCDs) are increasingly being expanded. The LCDs are being applied to portable mobile devices, e.g., portable computers, personal digital assistants (PDAs), portable game machines, digital cameras, portable media players, and e-books. Examples of portable computers include notebook computers, office automation equipment, audio/video equipment, and indoor/outdoor advertisement display devices.

As a representative type of LCD, transmissive LCDs control an electric field that is applied to a liquid crystal layer, control light input from a backlight unit according to a data voltage, and thus display an image. For example, fluorescent lamps, e.g., Cold Cathode Fluorescent Lamps (CCFLs), are used as the light sources of the backlight units. In another example, Light Emitting Diodes (LEDs), which are more efficient than the fluorescent lamps in terms of power consumption power, weight, and brightness, may be used as light sources as well.

SUMMARY

The present disclosure provides a light source driving circuit and a display device including the same, which minimize power consumption of LEDs used as a light source.

Embodiments of the inventive concept provide a light source driving circuit for driving a light source, including a driving voltage generator configured to supply power to a light source, and a light source controller configured to generate a light source control signal for periodically turning on/off the light source, the light source being turned on again before being turned off completely.

The light source controller may include a Pulse Width Modulation (PWM) circuit.

The light source controller may be configured to set a frequency of the light source control signal for the light source to be turned on again before being turned off completely.

The light source controller may be configured to set the frequency of the light source control signal in response to a frequency control signal input from outside.

The light source controller may be configured to adjust the frequency, such that a falling time of the light source in one period and a rising time of the light source in a subsequent period overlap.

The light source may be a LED.

The light source may be configured to emit light when a current therethrough is zero.

Embodiments of the inventive concept further provide a display device, including a display panel including a plurality of pixels for displaying an image, a light source on the display panel, and a light source driving circuit configured to drive the light source, the light source driving circuit having a driving voltage generator configured to supply power to the light source, and a light source controller configured to generate a light source control signal for periodically turning on/off the light source, the light source being turned on again before being turned off completely.

The light source controller may include a PWM circuit.

The light source controller may be configured to set a frequency of the light source control signal for the light source to be turned on before being turned off completely.

The light source controller may be configured to set the frequency of the light source control signal in response to a frequency control signal input from outside.

The light source may be a LED.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Exemplary embodiments of the inventive concept will be described below in more detail with reference to the accompanying drawings. The inventive concept may, however, be embodied in different forms and should not be construed as limited to the embodiments set forth herein. Rather, these embodiments are provided so that this disclosure will be thorough and complete, and will fully convey the scope of the inventive concept to those skilled in the art.

Figure 1:
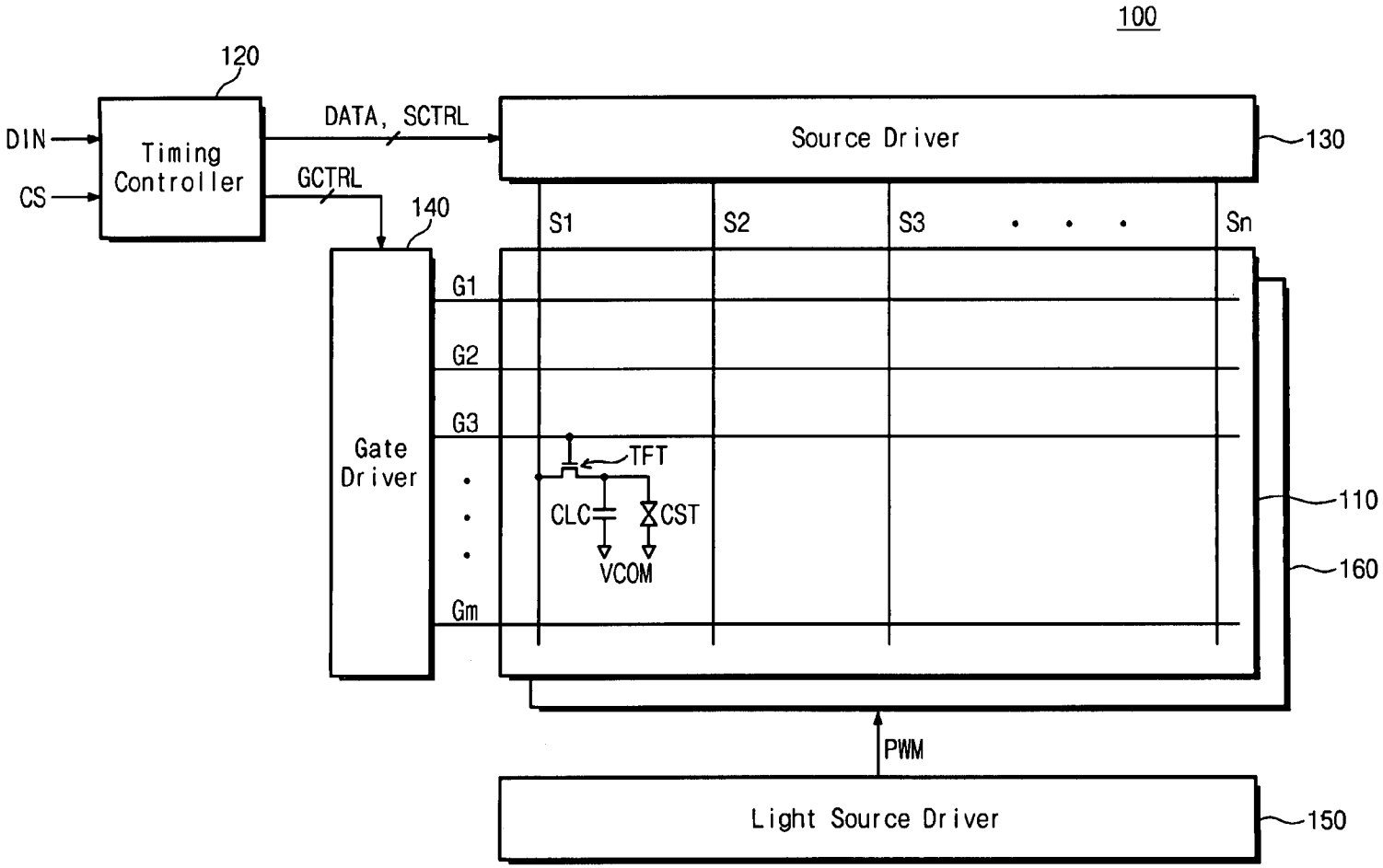
FIG. 1 is a block diagram illustrating a display device according to an embodiment of the inventive concept.

FIG. 1 is a block diagram illustrating a display device according to an embodiment of the inventive concept.

Referring to FIG. 1, a display device 100 according to an embodiment of the inventive concept includes a display panel 110, a timing controller 120, a source driver 130, a gate driver 140, a light source driver 150, and a backlight unit 160.

The display panel 110 includes a plurality of gate lines G1 to Gm, a plurality of source lines S1 to Sn that perpendicularly intersect the gate lines G1 to Gm, and a plurality of pixels that are respectively formed at the intersection points of the gate lines and source lines, wherein the pixels are arranged in a matrix structure. Each of the pixels includes a thin film transistor TFT having a gate electrode connected to a gate line and a source electrode connected to a source line, a liquid crystal capacitor CLC having one end connected to a drain electrode of the thin film transistor TFT, and a storage capacitor CST having one end connected to the drain electrode of the thin film transistor TFT. Another end of the liquid crystal capacitor CLC and another end of the storage capacitor CST are connected to a common voltage VCOM. In such a pixel structure, the gate lines G1 to Gm are sequentially selected by the gate driver 140, and when a pulse type of gate-on voltage is applied to the selected gate line, a thin film transistor of a pixel connected to the selected gate line is turned on. Subsequently, the source driver 130 applies a source driving signal to each of the source lines S1 to Sn. The source driving signal is applied to the liquid crystal capacitor CLC and the storage capacitor CST through the thin film transistor TFT to drive the capacitors CLC and CST, and thus a certain display operation is performed.

The timing controller 120 converts an external data signal DIN input from the outside into a data signal DATA that may be processed by the source driver 130, and outputs the data signal DATA to the source driver 130. The timing controller 120 provides a source control signal SCTRL to the source driver 130, and provides a gate control signal GCTRL to the gate driver 140. Herein, the gate control signal GCTRL includes a gate start pulse and a gate shift clock.

The gate driver 140 outputs a plurality of gate driving signals for sequentially driving the gate lines G1 to Gm in response to the gate control signal GCTRL from the timing controller 120. That is, the gate driver 140 sequentially provides a gate-on voltage to the gate lines G1 to Gm, and provides a gate-off voltage to gate lines that do not receive the gate-on voltage.

The backlight unit 160 is a light emitting body for irradiating light on the display panel 110. The backlight unit 160 includes a plurality of LEDs (not shown). The LED is a semiconductor device that emits light when voltage is applied in a forward direction thereto, and intensity of light is determined according to the amount of current therethrough.

The light source driver 150 outputs a light source control signal PWM for controlling the LEDs of the backlight unit 160. The light source control signal PWM is periodically, e.g., with a constant period, turning on/off the LEDs of the backlight unit 160.

Figure 2:
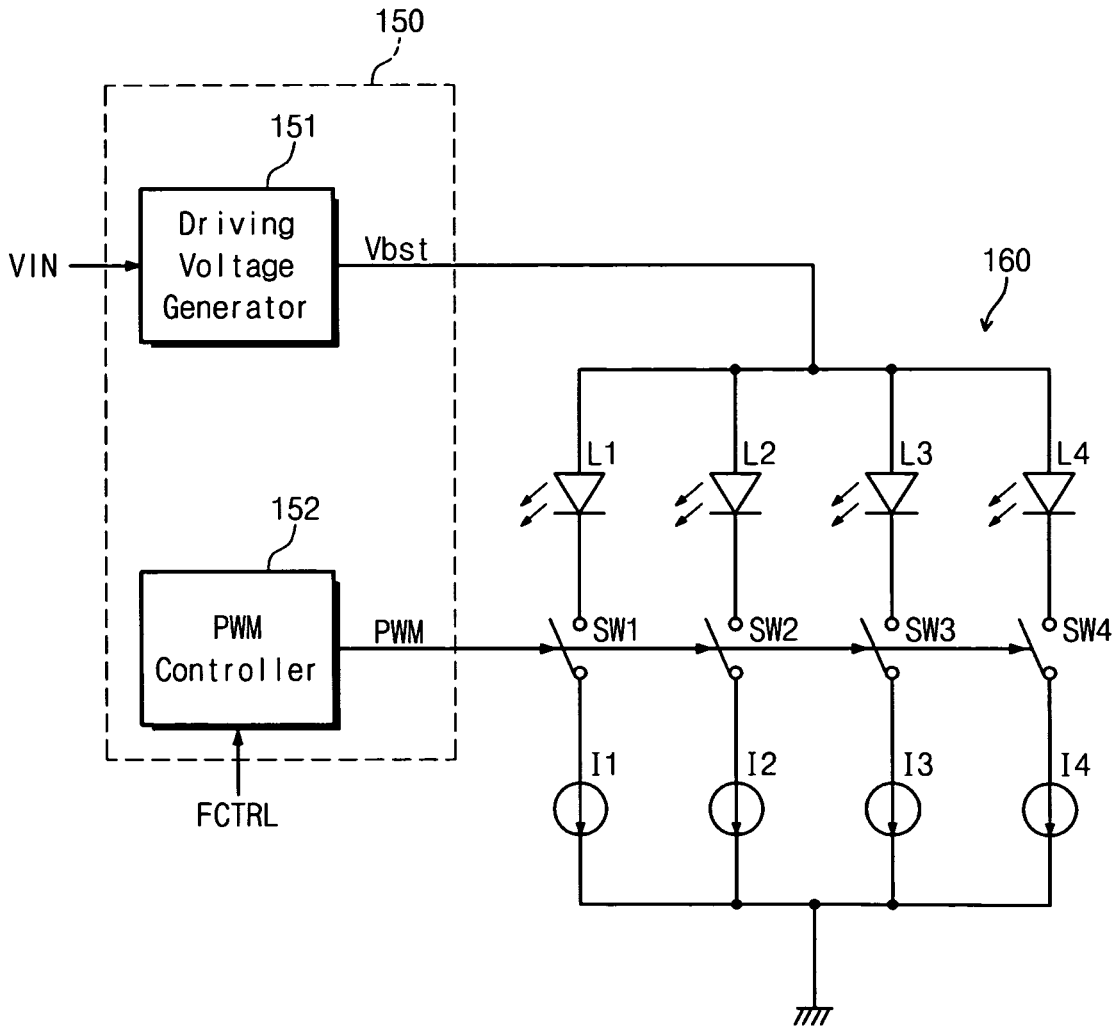
FIG. 2 is a detailed block diagram illustrating a light source driver and a backlight unit according to an embodiment.

FIG. 2 is a block diagram illustrating a detailed configuration of the light source driver 150 and backlight unit 160.

Referring to FIG. 2, the backlight unit 160 includes a plurality of LEDs, e.g., LEDs L1 to L4, and a plurality of switches, e.g., switches SW1 to SW4. The LEDs L1 to L4 correspond to the switches SW1 to SW4 in a one-to-one correspondence relationship. The LED L1 and the switch SW1 are serially and sequentially connected between a boosting voltage Vbst from the light source driver 150 and a ground voltage. The other LEDs L2 to L4 and switches SW2 to SW4 are serially and sequentially connected between the boosting voltage Vbst and the ground voltage in a same manner. In an embodiment illustrated in FIG. 2, the backlight unit 160 includes only four LEDs L1 to L4, but it is not limited thereto. The number and array of LEDs in the backlight unit 160 may be variously changed.

The light source driver 150 includes a driving voltage generator 151, and a Pulse Width Modulation (PWM) controller 152. The driving voltage generator 151 generates the boosting voltage Vbst for driving the LEDs L1 to L4. The PWM controller 152 outputs the light source control signal PWM for controlling the switches SW1 to SW4 of the backlight unit 160. The light source control signal PWM periodically turns on/off the switches SW1 to SW4 to control brightness of the LEDs L1 to L4.

Figure 3:
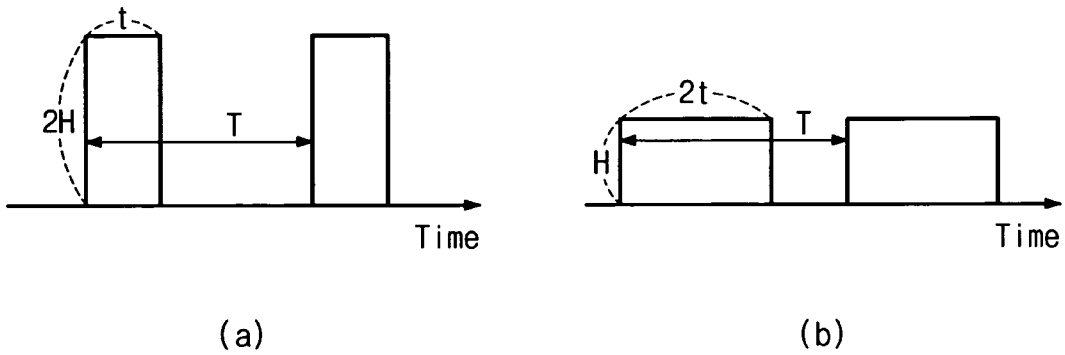
FIG. 3 is a diagram illustrating a theoretical background for controlling brightness of a backlight unit using a light source control signal.

FIG. 3 is a diagram illustrating a theoretical background for controlling brightness of a backlight unit using a light source control signal.

Referring to FIG. 3, brightness of light that is flashing with a predetermined period T is recognized as a root mean square value or a mean value. That is, a response (R) is the multiplication of intensity H of the light, i.e., intensity of the pulse, and time t, i.e., length of one pulse of the flashing light.

For example, light having pulses with an intensity of 2H for a length oft, i.e., as illustrated in portion (a) of FIG. 3, and light having pulses with an intensity of H for a length of 2t, i.e., as illustrated in portion (b) of FIG. 3, are recognized as having a same brightness at the same period T, i.e., both have a response (R) of 2Ht. Based on such features, a duty ratio of the light source control signal PWM varies for controlling linear brightness. That is, the duty ratio increases in proportion to a section (i.e., an "on" section) where the light source brightness of the LEDs L1 to L4 control signal PWM has a high level.

The PWM controller 152 of FIG. 2 is configured with a pulse width modulation circuit so as to control the brightness of the LEDs L1 to L4, and the light source control signal PWM is a pulse width modulation signal.

Figure 4:
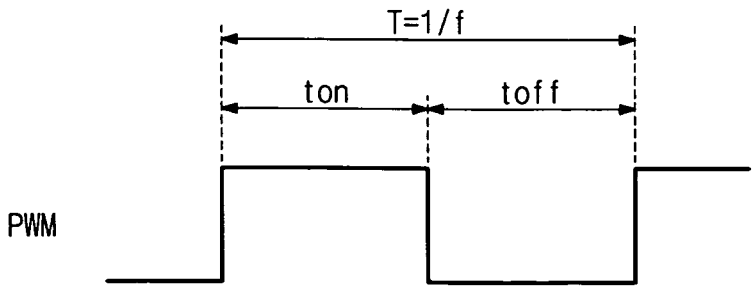
FIG. 4 is a timing diagram showing an example of a light source control signal which is output from a PWM controller in FIG. 2.

FIG. 4 is a timing diagram showing an example of a light source control signal which is output from the PWM controller 152 of FIG. 2.

Referring to FIG. 4, one period T of the light source control signal PWM, which is output from the PWM controller 152 of FIG. 2, includes an "on" section ton for turning on the LEDs L1 to L4, and an "off" section toff for turning off the LEDs L1 to L4. As the "on" section ton in one period T is extended, brightness of the LEDs L1 to L4 increases. One period T of the light source control signal PWM is the inverse number of frequency.

When the light source control signal PWM is shifted from a low level to a high level, the switches SW1 to SW4 are turned on, and thus, the LEDs L1 to L4 emit light. On the other hand, when the light source control signal PWM is shifted from a high level to a low level, the switches SW1 to SW4 are turned off, and thus, the LEDs L1 to L4 are turned off. At this point, as the switches SW1 to SW4 are turned on, a predetermined rising time is required for the LEDs L1 to L4 to emit light. Similarly, as the switches SW1 to SW4 are turned off, a predetermined falling time is required to turnoff the LEDs L1 to L4 completely. In an embodiment of the inventive concept, a frequency f of the light source control signal PWM output from the PWM controller 152 of FIG. 2 is set so that the LEDs L1 to L4 may be again turned on before being turned off completely. That is, the frequency f of the light source control signal PWM is set so that a falling time at one predetermined period of the LEDs L1 to L4 may be partially overlapped with a rising time of a subsequent period.

Figure 5:
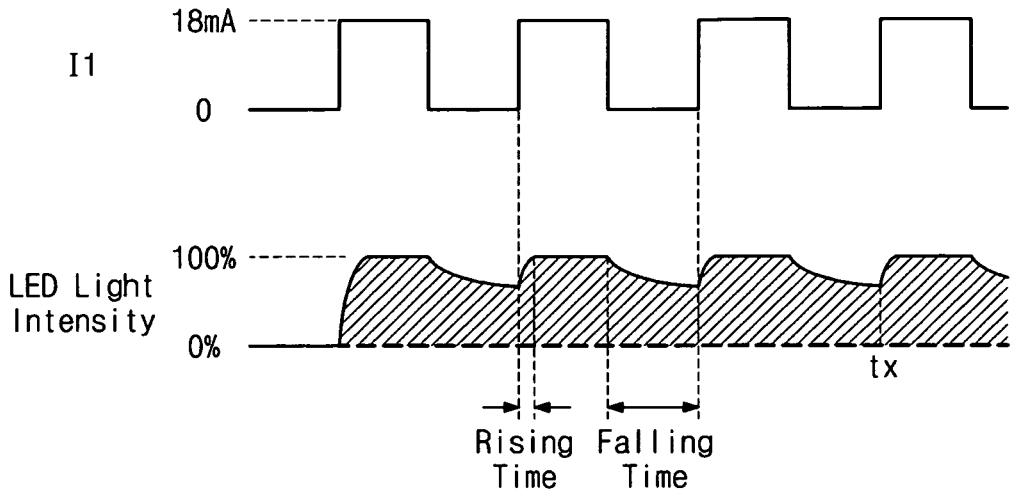
FIG. 5 is a diagram exemplarily showing a response time of an LED based on the amount of current which flows through the LED.

FIG. 5 is a diagram exemplarily showing a response time of a LED based on the amount of current which flows through the LED.

Referring to FIGS. 2 and 5, as the switch SW1 in FIG. 2 is turned on or off, a current I1 flowing through the LED L1 is about 18 mA or about 0 mA, respectively. In this case, when the frequency f of the light source control signal PWM is sufficiently high, the falling time is partially overlapped with the rising time in the response of the LED L1. That is, the LED L1 starts emitting light again before being turned off completely. For example, as illustrated in FIG. 5, when a pulse of 18 mA is applied to the LED L1 at time $t_x$, the LED light intensity of the LED L1 that is, e.g., between about 50% to about 80%, starts increasing during the rising time. Moreover, as further illustrated in FIG. 5, even when the current I1 flowing through the LED L1 is about 0 mA, the LED L1 emits light. Therefore, brightness of the LEDs L1 to L4 increases, and consumption power decreases.

Figure 6:
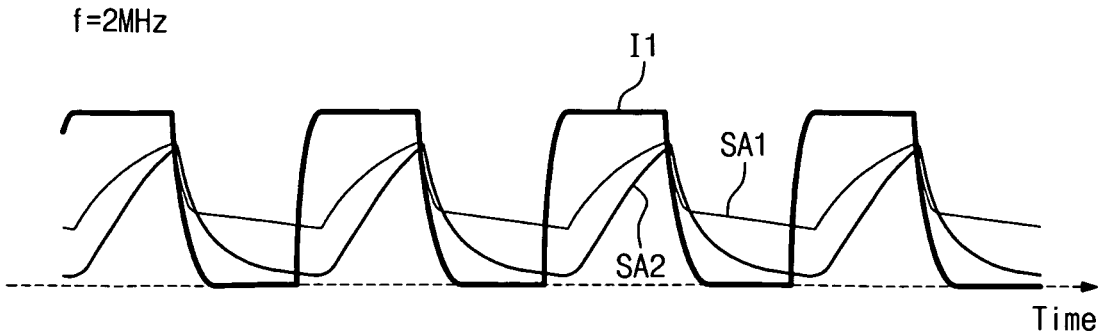
FIGS. 6 and 7 are diagrams respectively showing LED response times based on a frequency of a light source control signal.
Figure 7:
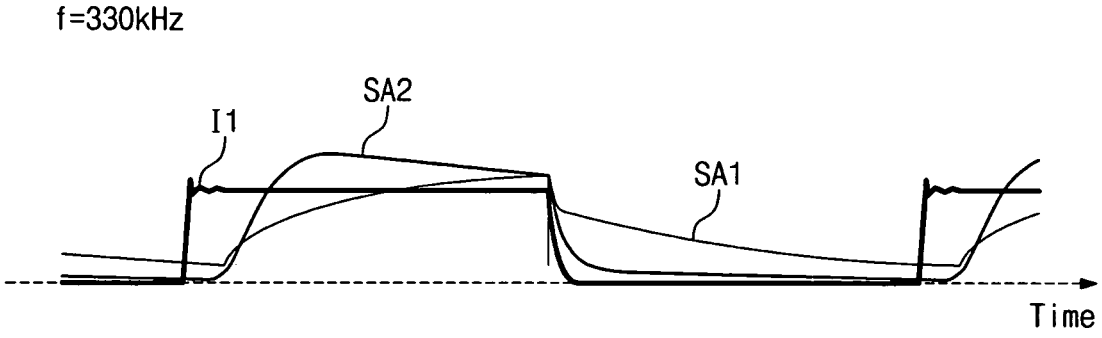

FIGS. 6 and 7 are diagrams respectively showing LED response times based on a frequency of a light source control signal.

FIG. 6 shows respective response times of LEDs of two display devices SA1 and SA2 having different characteristics when the frequency f of the light source control signal PWM is about 2 MHz. FIG. 7 shows respective response times of the LEDs of the two display devices SA1 and SA2 having different characteristics when the frequency f of the light source control signal PWM is about 2 KHz. In FIGS. 6 and 7, the current I1 refers to the current flowing through a LED.

Comparing FIGS. 6 and 7, it can be seen that as the frequency f of the light source control signal PWM becomes higher, an amount of time that the LED is turned off decreases. For example, as illustrated in FIG. 6, the LED is not completely turned off and exhibits an intensity of emitted light above zero. Further, the intensity of the emitted light in the LED is above zero when the current I1 is about 0 mA.

As shown in FIG. 7, when the frequency f of the light source control signal PWM is low, a falling time of the LED of the display device SA1 is longer than that of the LED of the display device SA2. As shown in FIG. 6, when the current I1 is about 0 mA, it can be seen that the LED is not completely turned off and the left amount of light is higher in the display device SA1 having a relatively longer falling time than the display device SA2 having a relatively shorter falling time.

As described above, the frequency f of the light source control signal PWM output by the PWM controller 152 is set to be high. Thus, brightness of the LEDs L1 to L4 increases and power consumption decreases. The PWM controller 152 may change the frequency f of the light source control signal PWM in response to a frequency control signal PCTRL input from the outside. The frequency control signal PCTRL may be provided from the timing controller 120 of FIG. 1. In another embodiment of the inventive concept, the frequency control signal PCTRL may be directly input from the outside to the PWM controller 152 through an input pad (not shown).

According to the embodiments of the inventive concept, the power consumption of the LEDs that are used as the light source can be minimized. As such, e.g., mobile devices that receive power from a battery, may have increased operability.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A light source driving circuit for driving a light source, comprising:
- a driving voltage generator configured to supply power to a light source; and
- a light source controller configured to generate a light source control signal having a turn-on signal and a turn-off signal for periodically turning on/off the light source, wherein
- the light source controller is configured to adjust a frequency of the light source control signal to apply the turn-on signal to the light source before the light source completely stops emitting light by the turn-off signal.

2. The light source driving circuit of claim 1, wherein the light source controller includes a Pulse Width Modulation (PWM) circuit.

3. The light source driving circuit of claim 1, wherein the light source controller is configured to set the frequency of the light source control signal in response to a frequency control signal input from outside.

4. The light source driving circuit of claim 1, wherein the light source controller is configured to adjust the frequency, such that a falling time of the light source in one period and a rising time of the light source in a subsequent period overlap.

5. The light source driving circuit of claim 1, wherein the light source includes a Light Emitting Diode (LED).

6. The light source driving circuit of claim 1, wherein the light source is configured to emit light when the light source control signal is the turn-on signal.

7. The light source driving circuit of claim 1, wherein the light source controller is configured to adjust a frequency of the light source control signal to control a brightness of the light source for a duration of the turn-on signal.

8. The light source driving circuit of claim 1, wherein the light source controller is configured to adjust a frequency of the light source control signal to control a brightness of the light source for a duration of the turn-off signal.

9. The light source driving circuit of claim 1, wherein the light source controller is configured to adjust a frequency of the light source control to control a ratio between a brightness of the light source for a duration of the turn-on signal and a brightness of the light source for a duration of the turn-off signal.

10. A display device, comprising:
- a display panel including a plurality of pixels for displaying an image;
- a light source on the display panel; and
- a light source driving circuit configured to drive the light source, the light source driving circuit including:
  - a driving voltage generator configured to supply power to the light source, and
  - a light source controller configured to generate a light source control signal having a turn-on signal and a turn-off signal for periodically turning on/off the light source, wherein
  - the light source controller is configured to adjust a frequency of the light source control signal to apply the turn-on signal to the light source before the light source completely stops emitting light by the turn-off signal.

11. The display device of claim 10, wherein the light source controller includes a Pulse Width Modulation (PWM) circuit.

12. The display device of claim 10, wherein the light source controller is configured to set the frequency of the light source control signal in response to a frequency control signal input from outside.

13. The display device of claim 10, wherein the light source includes a Light Emitting Diode (LED).

14. The light source driving circuit of claim 10, wherein the light source controller is configured to adjust a frequency of the light source control signal to control a brightness of the light source for a duration of the turn-on signal.

15. The light source driving circuit of claim 10, wherein the light source controller is configured to adjust a frequency of the light source control signal to control a brightness of the light source for a duration of the turn-off signal.

16. The light source driving circuit of claim 10, wherein the light source controller is configured to adjust a frequency of the light source control signal to control a ratio between a brightness of the light source for a duration of the turn-on signal and a brightness of the light source for a duration of the turn-off signal.

* * * * *